US008619018B2

(12) United States Patent
Jang

(10) Patent No.: US 8,619,018 B2
(45) Date of Patent: Dec. 31, 2013

(54) METHOD OF MODIFYING PIXEL DATA, CONTROL UNIT FOR PERFORMING THE METHOD AND DISPLAY APPARATUS HAVING THE CONTROL UNIT

(75) Inventor: Dae-Gwang Jang, Incheon (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 667 days.

(21) Appl. No.: 12/617,118

(22) Filed: Nov. 12, 2009

(65) Prior Publication Data

US 2010/0123742 A1 May 20, 2010

(30) Foreign Application Priority Data

Nov. 20, 2008 (KR) ..... 2008-115642

(51) Int. Cl.
*G09G 3/34* (2006.01)

(52) U.S. Cl.
USPC ..... 345/102

(58) Field of Classification Search
None
See application file for complete search history.

(56) References Cited

U.S. PATENT DOCUMENTS

2006/0238487 A1* 10/2006 Shih ..... 345/102
2008/0248837 A1* 10/2008 Kunkel ..... 455/566
2008/0309611 A1* 12/2008 Yang ..... 345/102

* cited by examiner

*Primary Examiner* — Joseph Haley
(74) *Attorney, Agent, or Firm* — F. Chau & Associates, LLC

(57) ABSTRACT

In a method of compensating pixel data applied to a display panel which receives light from a backlight assembly including a light guide plate and a plurality of light-emitting blocks adjacent a side surface of the light guide plate, block representative values of image blocks are obtained. The block representative values of image blocks respectively correspond to the light-emitting blocks from pixel data of input image. Duty cycles of the light-emitting blocks are determined using the block representative values. Pixel brightness values are calculated using the duty cycles of the light-emitting blocks and brightness profile data in accordance with light-emitting regions of the light guide plate from which the light is emitted when a representative light-emitting block of the light-emitting blocks is driven. The pixel data may then be compensated based on the pixel brightness values.

19 Claims, 5 Drawing Sheets

METHOD OF MODIFYING PIXEL DATA, CONTROL UNIT FOR PERFORMING THE METHOD AND DISPLAY APPARATUS HAVING THE CONTROL UNIT

CROSS-REFERENCE TO RELATED APPLICATIONS

This application claims priority under 35 U.S.C. §119 to Korean Patent Application No. 2008-115642, filed on Nov. 20, 2008 in the Korean Intellectual Property Office (KIPO), the disclosure of which is incorporated by reference in its entirety herein.

BACKGROUND OF THE INVENTION

1. Technical Field

Embodiments of the present invention relate to a method of modifying pixel data, a control unit for performing the method and a display apparatus having the control unit.

2. Discussion of Related Art

A liquid crystal display (LCD) may include a liquid crystal display panel displaying an image using light-transmissibility of liquid crystal and a backlight assembly disposed under the liquid crystal panel to provide the liquid crystal display panel with light.

The backlight assembly includes a light source generating the light provided to the liquid crystal display panel. A cold cathode fluorescent lamp (CCFL), a light emitting diode (LED), etc., may be employed in the backlight assembly as the light source.

The LED can be manufactured in a chip form. The LED may be a choice as a light source for the backlight assembly because it lasts a long time and uses very little power.

The backlight assembly may be classified into an edge type backlight assembly or a direct type backlight assembly based on its position with respect to the light source. In a direct type backlight assembly, light sources are disposed under the liquid crystal display panel to directly provide the liquid crystal display panel with light. In an edge type backlight assembly, the light source is disposed adjacent a light guide plate and light generated from the light source is guided by the light guide plate to be provided to the liquid crystal display panel.

A dimming technology may be used to reduce the amount of light generated by the backlight assembly and increase the amount of light transmitted to pixels of the liquid crystal display panel. The dimming technology may improve a contrast ratio of the image and decrease power consumption. The dimming technology divides the light source into a plurality of light-emitting blocks and analyzes image blocks respectively corresponding to the light-emitting blocks. The dimming technology increases a grayscale level of pixel data according to a brightness level of the analyzed image blocks and decreases a grayscale level of the light-emitting blocks by an increment of the grayscale level of the pixel data.

In an edge-lit dimming method, the light source is disposed adjacent a side surface of the liquid crystal display panel. The distribution of brightness may vary in accordance with the position that light from the light source is incident, because the light spreads out as the distance from the light source increases. Further, a region of the liquid crystal display panel receives light from a closest light source and adjacent light sources.

Thus, there is a need for methods of modifying pixel data due to the variation in brightness, control units for performing the method and a display apparatuses having the control unit.

SUMMARY OF THE INVENTION

An exemplary embodiment of the present invention includes a method of modifying pixel data applied to a display panel which receives light from a backlight assembly including a light guide plate and a plurality of light-emitting blocks adjacent at least one side surface of the light guide plate. In the method of modifying pixel data, block representative values of image blocks are obtained from pixel data of an input image. The image blocks are divided to respectively correspond to the light-emitting blocks. Duty cycles of the light-emitting blocks are determined using the block representative values. Pixel brightness values are calculated using the duty cycles of the light-emitting blocks and brightness profile data in accordance with light-emitting regions of the light guide plate from which the light is emitted when a representative light-emitting block of the light-emitting blocks is driven. The pixel data may then be modified based on the pixel brightness values.

The display panel may include a plurality of first pixel regions and second pixel regions. The first pixel regions are arranged in a first direction in which the light-emitting blocks are arranged. The second pixel regions are arranged in a second direction crossing the first direction. Each of the second pixel regions may include a plurality of pixel lines. The pixel brightness values may respectively correspond to the pixel lines.

For calculating the pixel brightness values, line brightness profiles of the pixel lines may be calculated using first and second brightness profile data corresponding to the pixel lines and first pixel brightness values of pixels corresponding to boundary regions between the first pixel regions may be calculated using the line brightness profiles and the duty cycles of the light-emitting blocks. Second pixel brightness values of the remaining pixels may be calculated using the first pixel brightness values.

An exemplary embodiment of the present invention includes a control unit for a display panel. The control unit includes a representative value obtaining part, a duty determining part, a pixel brightness value calculating part, and a pixel data modifying part. The representative value obtaining part may obtain representative values of image blocks, which are divided to respectively correspond to a plurality of light-emitting blocks disposed adjacent at least one side surface of a light guide plate, from pixel data of input images applied to the display panel. The duty determining part may determine duty cycles of the light-emitting blocks using the representative values. The pixel brightness value calculating part may calculate pixel brightness values using the duty cycles of the light-emitting blocks and brightness profile data in accordance with light-emitting regions of the light guide plate from which light is emitted when a representative light-emitting block of the light-emitting blocks is driven. The pixel data modifying part may modify the pixel data of the input images based on the pixel brightness values.

The display panel may include a plurality of first pixel regions and second pixel regions. The first pixel regions are arranged in a first direction in which the light-emitting blocks are arranged and the second pixel regions are arranged in a second direction crossing the first direction. Each of the second pixel regions may include a plurality of pixel lines. The pixel brightness value of each pixel line may be calculated.

The pixel brightness value calculating part may include a line brightness profile calculator, a first pixel brightness value calculator, and a second pixel brightness value calculator. The line brightness profile calculator may calculate line brightness profiles of the pixel lines, using first and second profile data corresponding to the pixel line. The first pixel brightness value calculator may calculate first pixel brightness values of pixels corresponding to boundary regions between the first pixel regions, using the line brightness profiles and duty cycles of the light-emitting blocks. The second pixel brightness value calculator may calculate second pixel brightness values of remaining pixels of the pixel line, using the first pixel brightness values.

An exemplary embodiment of the present invention includes a display apparatus. The display apparatus includes a display panel, a backlight unit, and a control unit. The backlight unit provides the display panel with light and includes a light guide plate and a plurality of light-emitting blocks disposed adjacent a side surface of the light guide plate. The control unit obtains representative values of image blocks from pixel data of input images to determine duty cycles of the light-emitting blocks and modify the pixel data of the input images using the duty cycles of the light-emitting blocks and brightness profile data in accordance with light-emitting regions of the light guide plate from which the light is emitted when a representative light-emitting block of the light-emitting blocks is driven.

BRIEF DESCRIPTION OF THE DRAWINGS

The present invention will become readily apparent by reference to the following detailed description when considered in conjunction with the accompanying drawings in which.

DETAILED DESCRIPTION OF EXEMPLARY EMBODIMENTS

The present invention is described more fully hereinafter with reference to the accompanying drawings, in which exemplary embodiments of the present invention are shown. The present invention may, however, be embodied in many different forms and should not be construed as limited to the exemplary embodiments set forth herein.

It will be understood that when an element or layer is referred to as being "on," "connected to" or "coupled to" another element or layer, it can be directly on, connected or coupled to the other element or layer or intervening elements or layers may be present. Like numerals refer to like elements throughout.

Hereinafter, exemplary embodiments of the present invention will be explained in detail with reference to the accompanying drawings.

Figure 1:
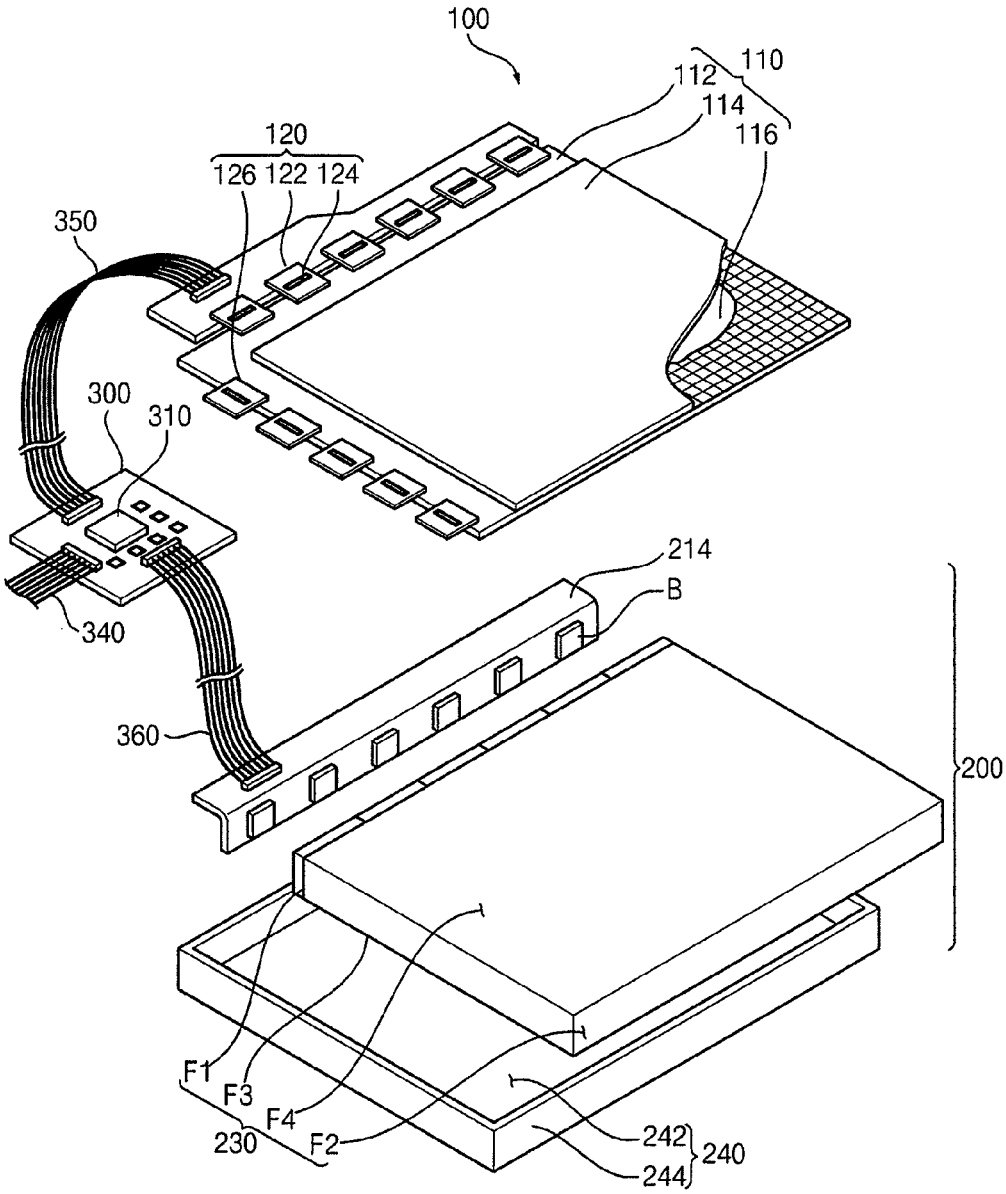
FIG. 1 is a perspective view illustrating a display apparatus in accordance with an exemplary embodiment of the present invention.
Figure 2:
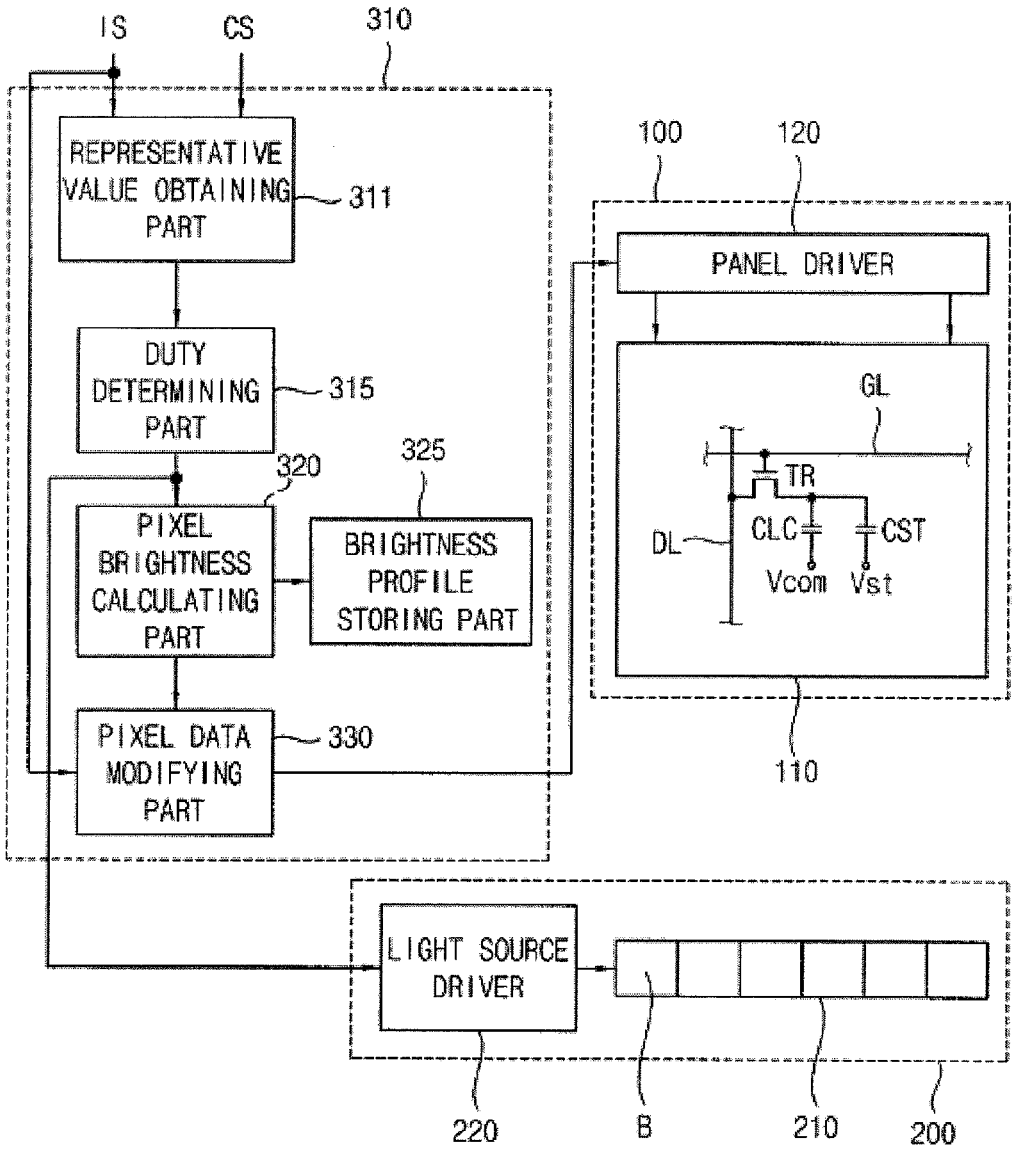
FIG. 2 is a block-diagram illustrating an exemplary embodiment of the display apparatus illustrated in FIG. 1.

FIG. 1 is a perspective view illustrating a display apparatus in accordance with an exemplary embodiment of the present invention. FIG. 2 is a block-diagram illustrating an embodiment of the display apparatus illustrated in FIG. 1.

Referring to FIGS. 1 and 2, the display apparatus includes a display unit 100, a backlight unit 200, and a controlling board 300. The display unit 100 includes a display panel 110 and a panel driving unit 120.

The display panel 110 includes a first substrate 112, a second substrate 114 opposing the first substrate 112, and a liquid crystal layer 116 interposed between the first and second substrates 112 and 114. The first substrate 112 may include a plurality of pixels P, which display an image. Each of the pixels P may include a switching element TR connected to a gate line GL and a data line DL, and a liquid crystal capacitor CLC and a storage capacitor CST, which are connected to the switching element TR.

The panel driving unit 120 may include a source printed circuit board 122, a data driving circuit film connecting the source printed circuit board 122 with the display panel 110, and a gate driving circuit film 126 connected to the display panel 110. The data driving circuit film 124 may be connected to the data lines of the first substrate 112. The gate driving circuit film 126 may be connected to the gate lines of the first substrate 112. The data driving circuit film 124 and the gate driving circuit film 126 may respectively include a data driving chip and a gate driving chip, which provide the display panel 110 with driving signals for driving the display panel 110 in response to a control signal from the source printed circuit board 122.

The backlight unit 200 includes a light source 210, a light source driver 220, a light guide plate 230, and a receiving container 240. The backlight unit 200 is disposed under the display unit 100 and provides the display unit 100 with light. The backlight unit 200 may include an edge type backlight unit. In the edge type backlight unit, the light source 210 may be disposed adjacent at least one side surface of the light guide plate 230.

The light source 210 may include a point light source. The point light source may be a light-emitting diode (LED). The light source 210 is mounted on a driving substrate 214. The driving substrate 214 may include a plurality of control lines (not shown) for controlling the light source 210 and a plurality of power lines (not shown) for providing the light source 210 with electric power. The light source 210 may include white LEDs generating white light. Alternatively, the light source 210 may include red LEDs generating red light, green LEDs generating green light, and blue LEDs generating blue light. The light source 210 may include a plurality of light-emitting blocks B. Each of the light-emitting blocks B may include at least one LED. The light-emitting blocks B may be arranged along at least one side surface of the light guide plate 230 and may be driven by a one dimensional local dimming method.

The light source driver 220 may generate driving signals, which drive the light-emitting blocks B using a duty cycle of each light-emitting block B, which is outputted from the controlling board 300. The light source driver 220 applies the driving signals to the light-emitting blocks B.

The light guide plate 230 guides the light from the light source 210 into the display panel 110. The light guide plate 230 may include a first surface F1, a second surface F2, a third surface F3, and a fourth surface F4. The light emitted from the light source 210 may be incident to the first surface F1 and may exit from the third surface F3. The second surface F2 may be opposite to the first surface F1. The fourth surface F4 may be opposite to the third surface F3. The third surface F3 may be substantially perpendicular to the first and second surfaces F1 and F2.

The receiving container 240 may be configured to receive the display unit 100, the light source 210 and the light guide plate 230. The receiving container 240 may include a bottom plate 242 and sidewalls 244 extending from edge portions of the bottom plate 242.

The backlight unit 200 may include an optical sheet (not shown). The optical sheet may be disposed between the display panel 110 and the light guide plate 230 and may improve optical characteristics of the light exiting from the light guide plate 230. For example, the optical sheet may include a diffusing sheet improving brightness uniformity and at least one prism sheet improving front brightness.

The controlling board 300 may be electrically connected to the display unit 100 and the backlight unit 200 to control the display unit 100 and the backlight unit 200. The controlling board 300 may include a control unit 310, a first connector 340, a second connector 350, and a third connector 360.

The first connector 340 may be electrically connected to an external device (not shown). The first connector 340 may provide an image signal IS and a control signal CS received from the external device to the control unit 310. The second connector 350 may be electrically connected to the display unit 100 to provide the display unit 100 with the image signal IS. The third connector 360 may be electrically connected to the light source driver 220 of the backlight unit 200.

The control unit 310 may include a representative value obtaining part 311, a duty determining part 315, a pixel brightness value calculating part 320, a brightness profile storing part 325, and a pixel data modifying part 330.

The representative value obtaining part 311 may obtain a representative block value from each of a plurality of image blocks, which are divided to respectively correspond to the light-emitting blocks B, using the control signal CS and the image signal IS inputted from the external device. The representative value may be a maximum grayscale value or an average grayscale value of pixel data of each image block. Alternatively, the representative block value may range between the maximum grayscale value and the average grayscale value.

The duty determining part 315 may determine a duty cycle for controlling the brightness of each light-emitting block, using the representative block value.

The pixel brightness value calculating part 320 may calculate pixel brightness values using brightness profile data according to positions of a light-emitting region of the light guide plate 230 from which the light exits. The duty cycle may be determined by the duty determining part 315. The brightness profile data may be stored in the brightness profile storing part 325.

The brightness profile storing part 325 may store the brightness profile data according to the positions of the light-emitting region of the light guide plate 230. The brightness profile data may be measured when a representative light-emitting block of the light-emitting blocks B is driven in a full-white condition. Brightness profile data of the remaining light-emitting blocks may be substantially the same as that of the representative light-emitting block, except for position information. Therefore, when the brightness profile data of the representative light-emitting block is determined, the brightness profile data of the remaining light-emitting blocks can be determined using the brightness profile data of the representative light-emitting block.

The light guide plate 230 may be divided into a plurality of light-emitting regions according to the distribution of brightness, which varies in accordance with the position that light from the light-emitting blocks B is incident. Since the light may spread out as the light propagates from the first surface F1 to the second surface F2, the distribution of brightness may vary in accordance with the position that light is incident. The pixels of the display panel 110 may be affected by light exiting from a corresponding light-emitting block and from adjacent light-emitting blocks. The pixel brightness value calculated by the pixel brightness value calculating part 320 may approximate the actual pixel brightness values, because the light exiting from the adjacent light-emitting blocks are taken into account when the pixel brightness values of the pixels are calculated.

Figure 3:
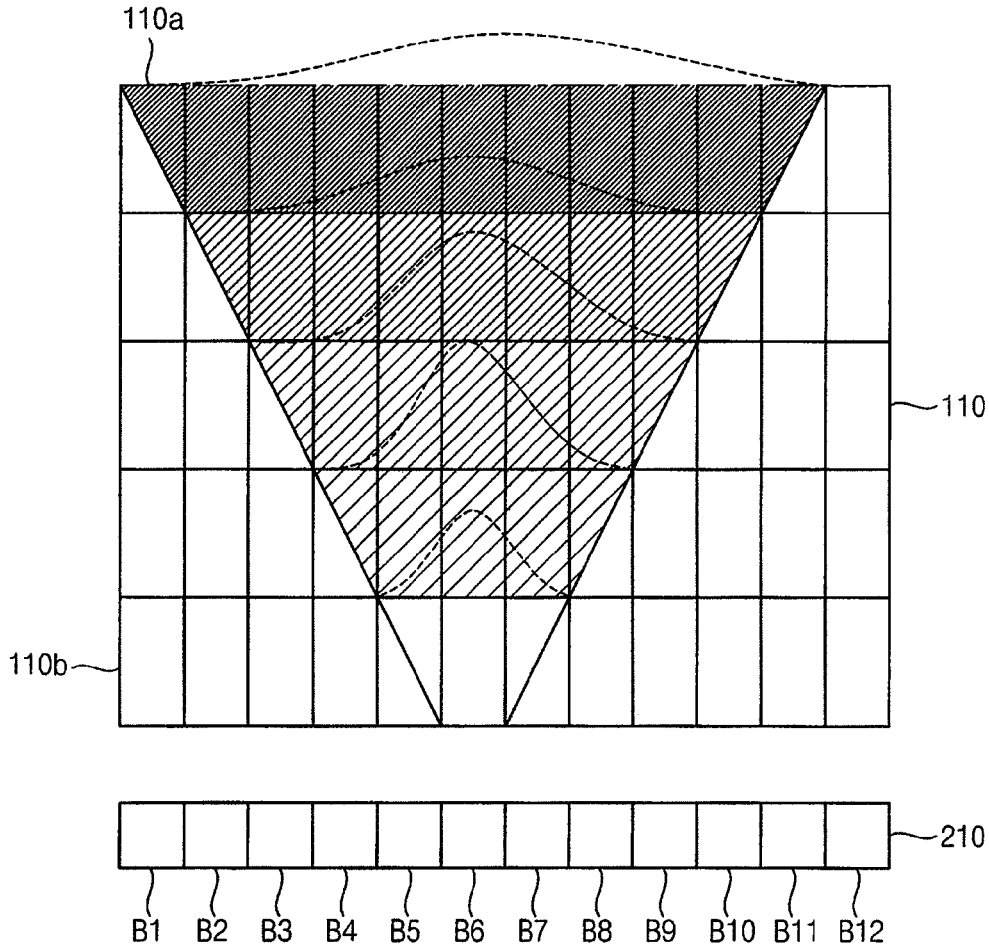
FIG. 3 is a plan view illustrating an exemplary embodiment of a display panel illustrated in FIG. 2.

FIG. 3 is a plan view illustrating an exemplary embodiment of the display panel illustrated in FIG. 2. Referring to FIGS. 2 and 3, the light source 210 includes a plurality of light-emitting blocks B1, B2, . . . , B12. For example, the light source 210 may include 12 light-emitting blocks B1, B2, . . . , B12. Each of the light-emitting blocks B1, B2, . . . , B12 may include at least one LED.

The display panel 110 may include a plurality of first pixel regions 110*a* and a plurality of second pixel regions 110*b*. The first pixel regions 110*a* may be arranged in a first direction in which the light-emitting blocks B1, B2, . . . , B12 are arranged. The second pixel regions 110*b* may be arranged in a second direction substantially perpendicular to the first direction. For example, the first pixel regions 110*a* may include 12 regions which respectively correspond to the light-emitting blocks B1, B2, . . . , B12. For example, the second pixel regions 110*b* may include 5 regions, which is divided in accordance with distance from the light-emitting blocks B1, B2, . . . , B12. Each of the second pixel regions 110*b* may include a plurality of pixel lines. When the second pixel region 110*b* includes 5 regions as illustrated in FIG. 3, the brightness profile storing part 325 may store 6 brightness profile data.

Figure 4:
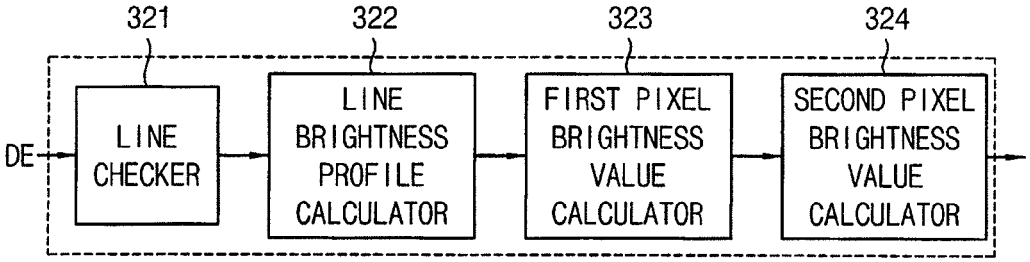
FIG. 4 is a block diagram illustrating an exemplary embodiment of a pixel brightness calculator illustrated in FIG. 2.

FIG. 4 is a block diagram illustrating an exemplary embodiment pixel brightness calculator illustrated in FIG. 2. Referring to FIGS. 2, 3 and 4, the pixel brightness value calculating part 320 may include a line checker 321, a line brightness profile calculator 322, a first pixel brightness value calculator 323, and a second pixel brightness value calculator 324.

The line checker 321 may determine which pixel line of the plurality of the pixel lines receives the pixel data to be modified. For example, the line checker 321 may determine which pixel line receives the pixel data to be modified, using a data enable signal DE, which is included in the control signal CS.

After the line checker 321 determines which pixel line receives the pixel data to be modified, the line brightness profile calculator 322 may read out a first brightness profile data and a second brightness profile data from the brightness profile storing part 325. The first and second brightness profile data correspond to a second pixel region 110*b* including the determined pixel line. For example, the first brightness profile data may include brightness profile information of a second pixel region 110*b* including the determined pixel line. The second brightness profile data may include brightness profile information of another second pixel region 110*b* adjacent the second pixel region 110*b* including the determined pixel line.

The light brightness profile calculator 322 may calculate the line brightness profile of the pixel line, using the first and second brightness profile data. For example, the line brightness profile calculator 322 may calculate the line brightness profile of the pixel line in a bi-linear interpolation method using the first and second brightness profile data.

The first pixel brightness value calculator 323 may calculate first pixel brightness values of pixels corresponding to boundary regions between the first pixel regions 110*a*, using the duty cycle of the light-emitting blocks. For example, the first pixel brightness value calculator 323 may calculate boundary brightness values corresponding to the boundary regions from the line brightness profile. The first pixel brightness value calculator 323 may calculate the first pixel brightness values of the pixels corresponding to the boundary regions by multiplying the boundary brightness values by the duty cycle of the light-emitting blocks, which affect the boundary brightness values.

The second pixel brightness value calculator 324 may calculate second pixel brightness values of the other pixels except for the pixels corresponding to boundary regions, using the first pixel brightness values. The other pixels may be disposed in a center region of each of the first pixel regions. For example, the second pixel brightness value calculator 324 may calculate the second pixel brightness values in a linear interpolation method using the first pixel brightness values.

The pixel data modifying part 330 may modify the pixel data of the image signal IS, using the first and second pixel brightness values received from the pixel brightness calculator 320.

Figure 5:
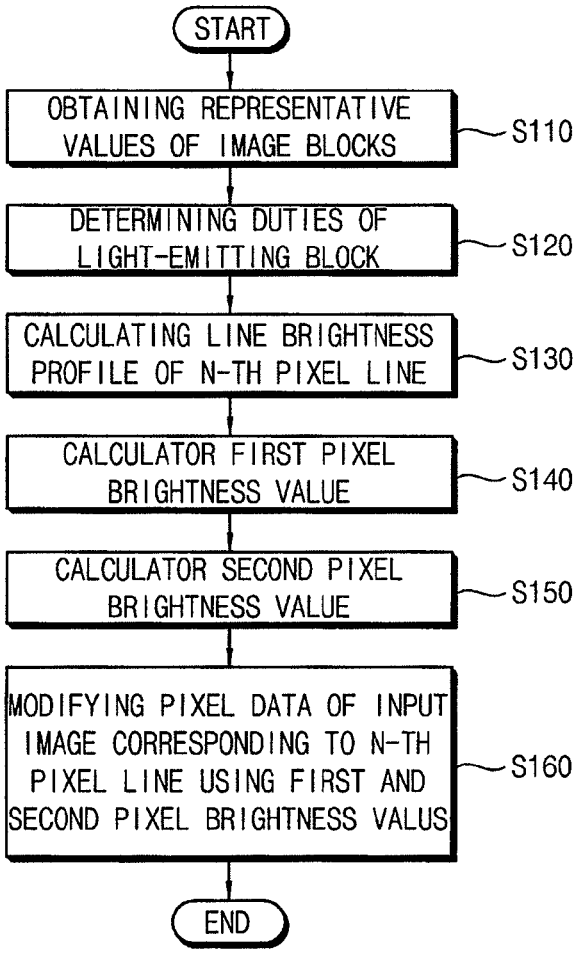
FIG. 5 is a flow chart illustrating a method of modifying a pixel data of a controller illustrated in FIG. 2 according to an exemplary embodiment of the present invention.
Figure 6:
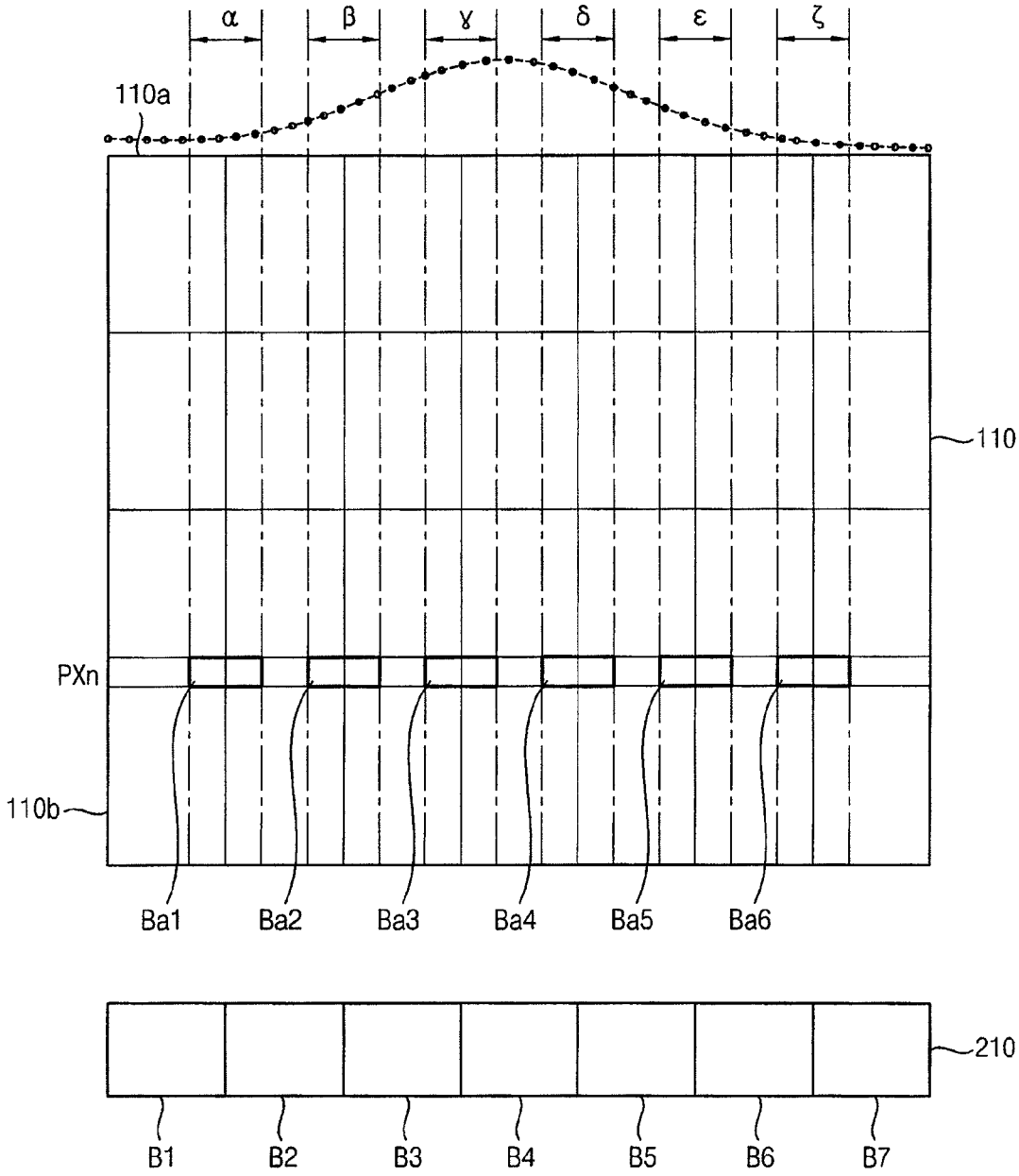
FIG. 6 is a plan view illustrating an embodiment of a display panel, which may employ the pixel brightness calculator illustrated in FIG. 2.

FIG. 5 is a flow chart illustrating a method of modifying pixel data of a controller illustrated in FIG. 2 according to an exemplary embodiment of the present invention. FIG. 6 is a plan view illustrating an embodiment of a display panel, which may include the pixel brightness calculator illustrated in FIG. 2.

Referring to FIGS. 2, 4, 5, and 6, the light source 210 may include a plurality of light-emitting blocks B1, B2, . . . , B7. Each of the light-emitting blocks may include at least one LED. The display panel 110 may include a plurality of first pixel regions 110*a* and a plurality of second pixel regions 110*b*. The first pixel regions 110*a* may be arranged in a first direction in which the light-emitting blocks B1, B2, . . . , B7 are arranged. The second pixel regions 110*b* may be arranged in a second direction substantially perpendicular to the first direction. For example, the display panel 110 may include 7 first pixel regions 110*a* and 4 second pixel regions 110*b*. Each of the second pixel regions 110*b* may include a plurality of pixel lines.

The representative value obtaining part 311 may obtain block representative values of image blocks, which is divided to respectively correspond to the light-emitting blocks B1, B2, . . . , B7, using the image signal IS (step S110). The block representative values may be one of a maximum grayscale value, an average grayscale value, and a middle grayscale value between the maximum grayscale value and the average grayscale value, which are grayscale values of the pixel data of each image block.

The duty determining part 315 may determine the duty cycle of the light-emitting blocks B1, B2, . . . , B7, using the block representative values (step S120).

The line brightness profile calculator 322 may calculate the line brightness profile of an n-th pixel line PXn, using the first and second brightness profile data, which is determined by the line checker 321 and corresponds to the second pixel region 110*b* including the n-th pixel line PXn (step S130). For example, when the n-th pixel line is formed in a second one of the second pixel regions 110*b* as illustrated in FIG. 6, the first brightness profile may correspond to the second one of the second pixel regions 110*b* and the second brightness profile may correspond to a third one of the second pixel regions 110*b*.

The first pixel brightness value calculator 323 may calculate first pixel brightness values of pixels corresponding to boundary regions Ba1, Ba2, . . . , Ba6, which correspond to the n-th pixel line PXn (step S140). For example, the first pixel brightness value calculator 323 may obtain the boundary brightness values corresponding to the boundary regions Ba1, Ba2, . . . , Ba6 from the line brightness profile. The first pixel brightness value calculator 323 may calculate the first pixel brightness values of the pixels corresponding to the boundary regions by multiplying the boundary brightness values by the duty cycle of the light-emitting blocks, which affect the boundary brightness values.

For example, the first pixel brightness values of the pixels corresponding to the third boundary region Ba3 of the boundary regions Ba1, Ba2, . . . , Ba6 of the n-th pixel line may be calculated as follows. First, the boundary brightness values of the line brightness profile corresponding to boundary regions are denoted α, β, γ, δ, ϵ, and ζ and the duty cycles of the light-emitting blocks B1, B2, . . . , B7 are denoted a, b, c, d, e, f, and g. The third boundary region Ba3 may be affected by the second, third, fourth, and fifth light-emitting blocks B2, B3, B4, and B5. Due to light-spreading, the second, third, fourth, and fifth light-emitting blocks B2, B3, B4, and B5 may affect the third boundary region Ba3 by α, β, γ, δ, ϵ, and ζ, respectively. The first pixel brightness values of the pixels corresponding to the third boundary region Ba3 may be calculated by Equation 1 as follows.

$$Px1_{Ba3}=(\zeta*b)+(\epsilon*c)+(\gamma*d)+(\beta*e) \quad \text{[Equation 1]}$$

The first pixel brightness values of the remaining boundary regions Ba1, Ba2, Ba4, Ba5, and Ba6 may be calculated by the same or a similar method. The number of light-emitting blocks affecting each of the boundary regions Ba1, Ba2, . . . , Ba6 may vary in accordance with the position of the boundary regions Ba1, Ba2, . . . , Ba6. For example, the number of light-emitting blocks affecting one boundary region disposed in a center region of the display panel 110 may be different from the number of the light-emitting blocks affecting another boundary region disposed in an edge region of the display panel 110. Further, the number of the light-emitting blocks may vary in accordance with the distance between the display panel 110 and the light-emitting blocks. For example, as the distance between the display panel 110 and the light-emitting blocks increases, the number of the light-emitting blocks may be increased.

The second pixel brightness value calculator 324 may calculate the second pixel brightness values of the remaining pixels of the pixel line (step S150). The remaining pixels may correspond to a center region of the first pixel regions 110*a*. For example, the second pixel brightness value calculator 324 may calculate the second pixel brightness values in a linear interpolation method using the first pixel brightness values.

The pixel data modifying part 330 may modify the pixel data of the image signal IS using the first and second pixel brightness values received from the first and second pixel brightness value calculators 323 and 324 (step S160).

According to at least one exemplary embodiment of the present invention, estimated pixel brightness values that approximate the actual pixel brightness values of a display panel may be calculated by taking into account influences of light emitted by both a predetermined light-emitting block and light-emitting blocks adjacent the predetermined light-emitting block. Further, pixel data of an image signal for the display panel may be modified using the estimated pixel brightness values, which may improve display quality of the display panel.

Although exemplary embodiments of the present invention have been described, those skilled in the art will readily appreciate that various modifications can be made without departing from the spirit and scope of the disclosure. Accordingly, all such modifications are intended to be included within the scope of the disclosure.

What is claimed is:

1. A method of modifying pixel data applied to a display panel, the method comprising:

obtaining block representative values of image blocks from pixel data of an input image, wherein the image blocks respectively correspond to a plurality of light-emitting blocks of a backlight assembly;

determining duty cycles of the light-emitting blocks using the block representative values;

determining boundary brightness values for boundary regions of the display panel between adjacent light-emitting blocks that are illuminated by light emitted by a light guide plate of the backlight assembly;

calculating pixel brightness values using the duty cycles of the light-emitting blocks and the boundary brightness values, wherein the light is emitted from the light guide plate when a representative light-emitting block of the light-emitting blocks is driven; and compensating the pixel data based on the pixel brightness values, wherein the display panel is configured to receive the light from the backlight and the light-emitting blocks are adjacent a side surface of the light guide plate.

2. The method of claim 1, wherein the display panel comprises a plurality of first pixel regions and second pixel regions, the first pixel regions being arranged in a first direction, wherein the light-emitting blocks are arranged in the first direction, the second pixel regions are arranged in a second direction crossing the first direction, and each of the second pixel regions comprises a plurality of pixel lines.

3. The method of claim 2, wherein calculating the pixel brightness values comprises:

calculating line brightness profiles of the pixel lines using first and second brightness profile data corresponding to the pixel lines;

calculating first pixel brightness values of pixels corresponding to boundary regions between the first pixel regions, using the line brightness profiles and the duty cycles of the light-emitting blocks; and calculating second pixel brightness values of remaining pixels using the first pixel brightness values.

4. The method of claim 2, wherein calculating the first pixel brightness values comprises multiplying each boundary brightness value of a boundary region by a duty cycle of the light-emitting block that affects the boundary region.

5. The method of claim 3, wherein the line brightness profiles are calculated in a bi-linear interpolation method using the first and second brightness profile data, and the second pixel brightness values are calculated in a linear interpolation method using the first pixel brightness values.

6. The method of claim 3, wherein a number of the light-emitting blocks affecting each of the boundary regions varies in accordance with positions of the boundary regions.

7. A control unit for a display panel, the control unit comprising:

a representative value obtaining part configured to obtain representative values of image blocks from pixel data of input images applied to the display panel, wherein the image blocks respectively correspond to a plurality of light-emitting blocks disposed adjacent a side surface of a light guide plate;

a duty determining part configured to determine duty cycles of the light-emitting blocks using the representative values;

a pixel brightness values calculating part calculating pixel brightness values, using the duty cycles of the light-emitting blocks and boundary brightness values for boundary regions of the display panel between adjacent light-emitting blocks that are illuminated by light emitted by the light guide plate, wherein the light is emitted from the light guide plate when a representative light-emitting block of the light-emitting blocks is driven; and a pixel data compensating part configured to compensate the pixel data of the input images based on the pixel brightness values.

8. The control unit of claim 7, wherein the display panel comprises a plurality of first pixel regions and second pixel regions, wherein the first pixel regions are arranged in a first direction, the light-emitting blocks are arranged in the first direction, the second pixel regions are arranged in a second direction crossing the first direction, and each of the second pixel regions comprises a plurality of pixel lines.

9. The control unit of claim 8, wherein the pixel brightness value calculating part comprises:

a line brightness profile calculator configured to calculate line brightness profiles of the pixel lines, using first and second profile data corresponding to the pixel line;

a first pixel brightness value calculator configured to calculate first pixel brightness values of pixels corresponding to boundary regions between the first pixel regions, using the line brightness profiles and duty cycles of the light-emitting blocks; and a second pixel brightness value calculator configured to calculate second pixel brightness values of remaining pixels of the pixel line, using the first pixel brightness values.

10. The control unit of claim 9, wherein a number of the light-emitting blocks affecting each of the boundary regions varies in accordance with positions of the boundary regions.

11. The control unit of claim 9, wherein the line brightness profile calculator calculates the line brightness profiles in a bi-linear interpolation method using the first and second brightness profile data.

12. The control unit of claim 9, wherein the second pixel brightness calculator calculates the second pixel brightness values in a linear interpolation method using the first pixel brightness values.

13. The control unit of claim 8, wherein the pixel brightness value calculating part comprises a line checker that is configured to determine a pixel line to be compensated using a data enable signal.

14. A display apparatus comprising:

a display panel;

a backlight unit configured to provide the display panel with light, the backlight unit including a light guide plate and a plurality of light-emitting blocks disposed adjacent a side surface of the light guide plate; and a control unit configured to obtain representative values of image blocks from pixel data of input images to determine duty cycles of the light-emitting blocks and compensate the pixel data of the input images using the duty cycles and boundary brightness values for boundary regions of the display panel between adjacent light-emitting blocks that are illuminated by light emitted by the light guide plate, wherein the light is emitted from the light guide plate when a representative light-emitting block of the light-emitting blocks is driven.

15. The display apparatus of claim 14, wherein the control unit comprises:

a representative value obtaining part configured to obtain block representative values of the image blocks from the pixel data of the input images;

a duty determining part configured to determine the duty cycles of the light-emitting blocks using the block representative values;

a pixel brightness calculating part configured to calculate pixel brightness values using the brightness profile data and the duty cycles of the light-emitting blocks; and a pixel data compensating part configured to compensate the pixel data of the input images based on the pixel brightness values.

16. The display apparatus of claim 15, wherein the display panel comprises a plurality of first pixel regions and second pixel regions, wherein the first pixel regions are arranged in a first direction, the light-emitting blocks are arranged in the first direction, and a plurality of second pixel regions arranged in a second direction crossing the first direction, and each of the second pixel regions comprises a plurality of pixel lines.

17. The display apparatus of claim 16, wherein the pixel brightness value calculating part comprises:

a line brightness profile calculator configured to calculate line brightness profiles of the pixel lines, using first and second profile data corresponding to the pixel line;

a first pixel brightness value calculator configured to calculate first pixel brightness values of pixels corresponding to boundary regions between the first pixel regions, using the line brightness profiles and duty cycles of the light-emitting blocks; and a second pixel brightness value calculator configured to calculate second pixel brightness values of remaining pixels of the pixel line, using the first pixel brightness values.

18. The display apparatus of claim 17, wherein the line brightness profile calculator calculates the line brightness profiles in a bi-linear interpolation method using the first and second brightness profile data.

19. The display apparatus of claim 17, wherein the second pixel brightness calculator calculates the second pixel brightness values in a linear interpolation method using the first pixel brightness values.

* * * * *